US009578406B2

(12) United States Patent
Ikeda

(10) Patent No.: US 9,578,406 B2
(45) Date of Patent: Feb. 21, 2017

(54) ACOUSTIC DEVICE

(71) Applicant: KYOCERA CORPORATION, Kyoto (JP)

(72) Inventor: Tomoyoshi Ikeda, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/786,432

(22) PCT Filed: Apr. 24, 2014

(86) PCT No.: PCT/JP2014/002317

§ 371 (c)(1),
(2) Date: Oct. 22, 2015

(87) PCT Pub. No.: WO2014/174849

PCT Pub. Date: Oct. 30, 2014

(65) Prior Publication Data

US 2016/0080849 A1 Mar. 17, 2016

(30) Foreign Application Priority Data

Apr. 25, 2013 (JP) ..... 2013-093097

(51) Int. Cl.
*H04R 25/00* (2006.01)
*H04R 1/10* (2006.01)
(Continued)

(52) U.S. Cl.
CPC ..... *H04R 1/1016* (2013.01); *H04R 1/105* (2013.01); *H04R 17/00* (2013.01); *H04R 25/02* (2013.01);
(Continued)

(58) Field of Classification Search
CPC ..... H04R 1/1016; H04R 1/105; H04R 17/00; H04R 2460/09; H04R 2430/01; H04R 2460/13; H04R 25/02
See application file for complete search history.

(56) References Cited

U.S. PATENT DOCUMENTS 6,944,307 B2 9/2005 Berg
8,331,593 B2 12/2012 Slemming et al.
(Continued)

FOREIGN PATENT DOCUMENTS

JP 2004-527931 A 9/2004
JP 2007-103989 A 4/2007
(Continued)

OTHER PUBLICATIONS

International Search Report and Written Opinion of the International Searching Authority with concise explanation, PCT/JP2014/002317, Jun. 24, 2014.
(Continued)

*Primary Examiner* — Tuan D Nguyen
(74) *Attorney, Agent, or Firm* — Studebaker & Brackett PC

(57) ABSTRACT

The disclosed acoustic device includes a holder 60 that has one end abutting the inside of an inferior antihelix crus and other end abutting a depression between a tragus and an antitragus of a user's ear and a vibrator 10 that is held by the holder 60 and, based on an audio signal, expands and contracts in a direction intersecting a direction of connecting the one end and the other end, and by the expansion and the contraction, causes the ear to vibrate.

13 Claims, 4 Drawing Sheets

(51) Int. Cl.
*H04R 17/00* (2006.01)
*H04R 25/02* (2006.01)

(52) U.S. Cl.
CPC ..... *H04R 2430/01* (2013.01); *H04R 2460/09* (2013.01); *H04R 2460/13* (2013.01)

(56) References Cited

U.S. PATENT DOCUMENTS

| | | | | |
|---|---|---|---|---|
| 8,634,582 | B2 | 1/2014 | Nielsen | |
| 8,948,430 | B2 | 2/2015 | Nielsen | |
| 2004/0052389 | A1 | 3/2004 | Berg | |
| 2008/0049955 | A1* | 2/2008 | Fujiwara | H04R 17/00 381/190 |
| 2009/0092269 | A1 | 4/2009 | Nielsen et al. | |
| 2009/0180654 | A1 | 7/2009 | Nielsen | |
| 2009/0202094 | A1 | 8/2009 | Ammitzboll et al. | |
| 2009/0290730 | A1 | 11/2009 | Fukuda et al. | |
| 2009/0323993 | A1 | 12/2009 | Slemming et al. | |
| 2010/0072860 | A1* | 3/2010 | Kim | H04R 17/005 310/324 |
| 2010/0202643 | A1 | 8/2010 | Nielsen | |
| 2015/0030189 | A1* | 1/2015 | Nabata | G10K 11/178 381/190 |
| 2015/0172823 | A1* | 6/2015 | Fukuoka | B06B 1/0611 381/162 |

FOREIGN PATENT DOCUMENTS

| | | | |
|---|---|---|---|
| JP | 2007-165938 | A | 6/2007 |
| JP | 2009-542056 | A | 11/2009 |
| JP | 2012-257049 | A | 12/2012 |
| WO | 2008/029515 | A1 | 3/2008 |

OTHER PUBLICATIONS

English computer translation of JP 2012-257049-A to Sonoya et al., published in Japanese on Dec. 27, 2012, aomputer translation obtained from J-PlatPat on Aug. 18, 2016.

* cited by examiner

ACOUSTIC DEVICE

CROSS-REFERENCE TO RELATED APPLICATION

This application claims priority to and the benefit of Japanese Patent Application No. 2013-093097 filed on Apr. 25, 2013, the entire contents of which are incorporated herein by reference.

TECHNICAL FIELD

This disclosure relates to an acoustic device such as an earphone, a hearing aid, or the like.

BACKGROUND

An acoustic device such as a prior inner-type earphone, or the like, was needed to be held by inserting a horn portion of a speaker thereof into an external ear canal.

SUMMARY

Technical Problem

However, the inner-type earphone is inserted so that it closes an external ear canal, thus it may shut out the outside sound and cause muffled sound when the earphone is mounted.

Therefore, this disclosure has been conceived in light of these circumstances, and it is an object of this disclosure to provide an acoustic device that is less likely to cause muffled sound.

Solution to Problem

The disclosed acoustic device includes a holder that has one end abutting the inside of an inferior antihelix crus and other end abutting a depression between a tragus and an antitragus of a user's ear, and a sound generator that is held by the holder and allows sound to be heard by the user in response to an audio signal.

Furthermore, the disclosed acoustic device includes a holder that has one end abutting the inside of an inferior antihelix crus and other end abutting a depression between a tragus and an antitragus of a user's ear and a vibrator that is held by the holder and expands and contracts in the direction intersecting the direction of connecting the one end and the other end based on an audio signal, and causes the ear to vibrate by the expansion and the contraction.

Moreover, in the disclosed acoustic device, the vibrator includes piezoelectric elements and panels. The piezoelectric elements expand and contract along the direction intersecting the direction of connecting the one end and the other end, and the panels vibrate along the direction intersecting the direction of connecting the one end and the other end.

Furthermore, in the disclosed acoustic device, the vibrator abuts the user's tragus from the inside of the user's ear to transmit the vibration to the tragus.

Moreover, in the disclosed acoustic device, the vibrator abuts the user's antitragus from the inside of the user's ear to transmit the vibration to the antitragus.

Furthermore, in the disclosed acoustic device, the vibrator is disposed so that it locates between the tragus and the antitragus.

Moreover, in the disclosed acoustic device, the direction in which the vibrator expands and contracts and the direction in which the holder bends occurring when the holder is mounted on the user's ear are different from each other.

Furthermore, in the disclosed acoustic device, the holder bends, in the region opposed to a crus of helix, in the direction away from the crus of helix.

Moreover, in the disclosed acoustic device, an external ear canal is not sealed by the acoustic device itself.

Furthermore, in the disclosed acoustic device, the vibrator abuts the user's tragus from the outside of the user's ear to transmit the vibration to the tragus, thereby allowing sound to be heard by the user.

Moreover, in the disclosed acoustic device, the vibrator abuts the user's antitragus from the outside of the user's ear to transmit the vibration to the antitragus, thereby allowing sound to be heard by the user.

Furthermore, in the disclosed acoustic device, the vibrator generates external ear canal radiation sound inside the user's ear.

Moreover, in the disclosed acoustic device, the vibrator is pressed against the user's ear with a force from 0.1N to 3N.

Furthermore, the disclosed acoustic device further includes a microphone.

Advantageous Effect

This disclosure provides an excellent acoustic device that causes less muffled sound.

DETAILED DESCRIPTION

The following describes an embodiment of this disclosure.

(Embodiment)

Figure 1:
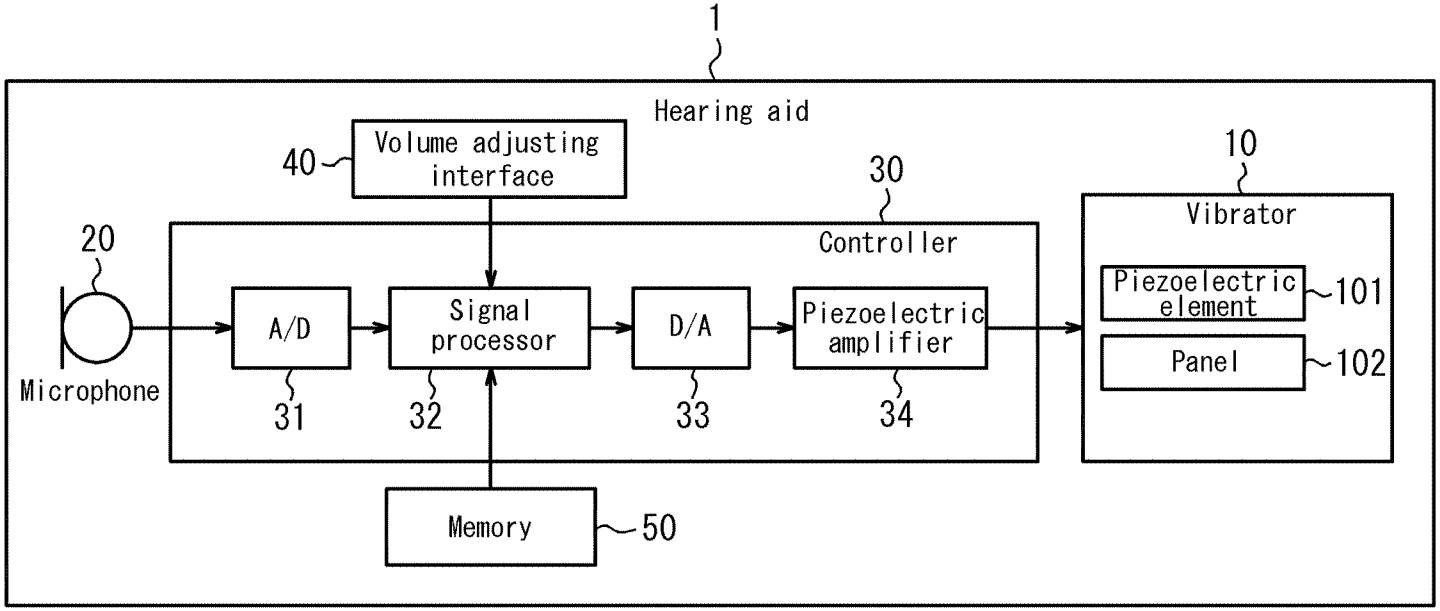
FIG. 1 is a block diagram illustrating a hearing aid according to one embodiment of this disclosure.

FIG. 1 is a block diagram illustrating an acoustic device 1 according to one embodiment of this disclosure. The acoustic device 1 is a hearing aid 1, for example, and includes a vibrator (sound generator) 10, a microphone 20, a controller 30, a volume adjusting interface 40, a memory 50 and a holder 60.

The acoustic device 1 is roughly divided into two parts, such as the vibrator 10 and the holder 60 held by an ear, and the microphone 20 and the controller 30 disposed in a housing. The housing in which the microphone 20 and the controller 30 are disposed may be put in a chest pocket, for example, to carry with, or may be held by an upper arm with a rubber band, or the like, which is a separate member.

Figure 2:
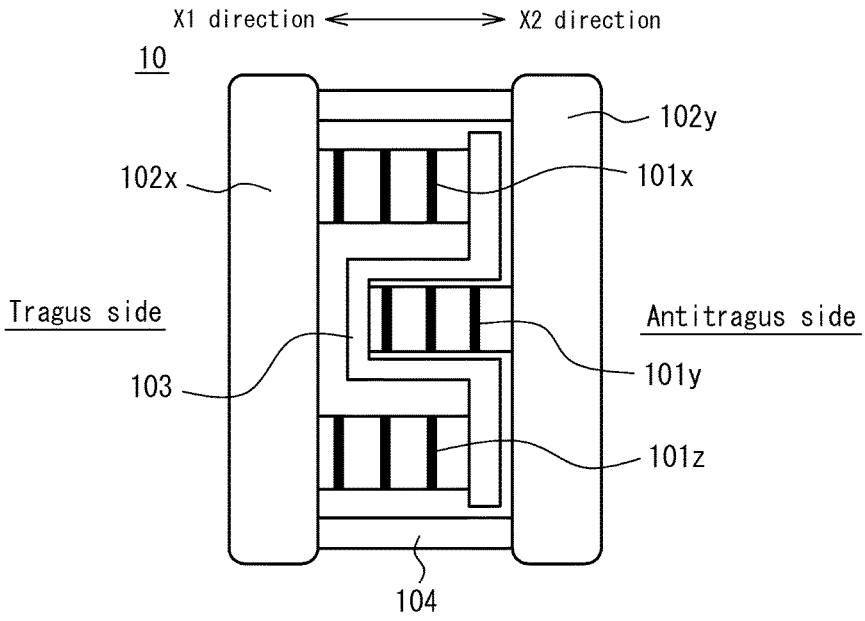
FIG. 2 is a cross-sectional diagram illustrating a vibrator of the hearing aid according to one embodiment of this disclosure.

The vibrator 10 includes stacked piezoelectric elements 101*x*, 101*y* and 101*z* that expand and contract in the stacking direction, and panels 102*x* and 102*y* vibrated by the piezoelectric elements 101. FIG. 2 illustrates a cross-sectional diagram of the vibrator in which the piezoelectric elements 101*x*, 101*y* and 101*z* cause the panels 102*x* and 102*y* to vibrate in the X-direction. The vibrator 10 may allow at least air conduction sound (radiation sound in external ear canal)

caused by vibration and human body vibration sound to be heard by the user. The radiation sound in the external ear canal is the sound transmitted to the user's auditory nerve when vibration of the air caused by vibration of human body is transmitted to the eardrum through the external ear canal and the eardrum is vibrated thereby. The human body vibration sound is the sound transmitted to the auditory nerve of the user through a portion (such as the cartilage of the external ear) of the user's body being in contact with a vibrating object. Note that depending on the area of the panels 102, normal air conduction sound generated when the air is pat by the surface of the panels may be generated.

The piezoelectric elements 101*x*, 101*y* and 101*z* are elements that expand and contract based on the electromechanical coupling coefficient of the component material when an electrical signal (voltage) is applied. These elements are made of, for example, ceramic or crystal. The piezoelectric elements 101 may be a stacked piezoelectric element formed by stacking hundreds of ceramic layers and electrode layers alternately. The stacked piezoelectric element is formed of a stacked structure of, for example, a plurality of dielectric layers made from PZT (lead zirconate titanate) and electrode layers disposed between the plurality of dielectric layers. The stacked piezoelectric element expands and contracts in the stacking direction when an electrical signal (voltage) is applied.

The panels 102*x* and 102*y* are formed of synthetic resin such as, for example, glass, acrylic, or the like. The panels 102 are preferably in the form of plate, and the following description is given assuming that the panels 102 are in the form of plate.

The microphone 20 collects sound from a sound source, specifically the sound that arrives at the user's ear.

The controller 30 performs various controls related to the hearing aid 1. The controller 30 applies a predetermined electrical signal (a voltage corresponding to an audio signal) to the piezoelectric elements 101. More specifically, in the controller 30, the audio signal collected by the microphone 20 is converted to a digital signal by an analog-digital converter 31. Then a signal processor 32 outputs a digital signal that drives the vibrator 10 based on the information related to the volume by a volume adjusting interface 40 and the information stored in a memory 50. A digital-analog converter 33 converts a digital signal to an analog electrical signal, which is amplified by a piezoelectric amplifier 34 and is applied to the piezoelectric elements 101.

The voltage applied by the controller 30 to the piezoelectric elements 101 may be ±15V or ±30V. Of course the audio device may have necessary power sources.

Thus the panels 102 generate a sufficient vibration, and human body vibration sound transmitted through a portion of the user's body can be generated. Note that the level of the applied voltage can be appropriately adjusted corresponding to the function of the piezoelectric elements 101. When the controller 30 applies an electrical signal to the piezoelectric elements 101, the piezoelectric elements 101 expand and contract in the X-direction.

The panels 102*x* and 102*y* move in opposite directions along the X-direction in response to expansion and contraction of the piezoelectric elements 101 in the X-direction. As a result of this, the panel 102*x* abuts one side of the ear and the panel 102*y* abuts the other side of the ear to allow vibration to be transmitted. Note that, although the condition where the panel 102*x* abuts the inner wall of the external ear canal on the back side of the tragus and the panel 102*y* abuts the back side of the antitragus is illustrated here, the condition is not limited thereto. For example, vibration may be transmitted by abutting only the inner wall of the external ear canal on the back side of the tragus, or vibration may be transmitted by abutting only the inner wall of the external ear canal on the back side of the antitragus. Further, the portion to be abutted is not limited to the back side of the tragus or the antitragus. It may be ear concha, antihelix, or the like.

In this embodiment, three piezoelectric elements 101*x*, 101*y* and 101*z* are used, and piezoelectric elements 101*x*, 101*y* and 101*z* are respectively attached to the rigid body 103. The rigid body 103 is preferably made from metal such as SUS, titanium, or the like, and has rigidity sufficient not to allow deformation thereof due to expansion of the piezoelectric elements 101, even in the state where the panels 102 abut the ear.

For piezoelectric elements 101*x* and 101*z*, their ends on the X2 direction side are respectively fixed to the rigid body 103 with adhesive or the like and their ends on the X1 direction side are respectively fixed to the panel 102*x* with adhesive or the like so that they can expand in the X1 direction illustrated in FIG. 2. Further, for the piezoelectric element 101*y*, its end on the X1 direction side is fixed to the rigid body 103 with adhesive or the like and its end in the X2 direction is fixed to the panel 102*y* with adhesive or the like so that it can expand in the X2 direction illustrated in FIG. 2 in synchronization with expansion of the piezoelectric elements 101*x* and 101*z*. Thus, the piezoelectric elements 101*x* and 101*z* and the piezoelectric element 101*y* expand in opposite directions at the same time, and as a whole, the moving width between panels can be increased more than the expansion width of each piezoelectric element. Note that, although the attaching method is not limited to adhesive, when adhesive is used, in order to directly transmit the expansion of the piezoelectric elements to the panels, hard adhesive such as epoxy or acrylic adhesive may preferably be used.

Besides the piezoelectric elements 101, a peripheral wall portion 104 that surrounds the piezoelectric elements 101 and forms a peripheral wall is provided between the panel 102*x* and the panel 102*y*. The peripheral wall portion 104 is provided to block the region where the piezoelectric elements 101, the rigid body 103, or the like, are disposed from the outer space, thereby preventing earwax, dust, water, or the like, from entering in. The peripheral wall may be, for example, a rubber material made into a tube, cloth, gore-tex or the like having a waterproof property, or a molding made from acrylic resin. Note that the peripheral wall may be formed of a soft material so that it will not prevent the piezoelectric elements from expanding or the panels from moving, or may be formed of folds so that it can follow the expansion.

As explained above, in the hearing aid 1 according to one embodiment of this disclosure, the microphone 20 collects sound from the sound source, and the vibrator 10 causes the panels 102 to vibrate, thereby allowing the sound to be heard by the user. The panels 102 vibrate, and thus generate air conduction sound including radiation sound in external ear canal and, when the user brings his/her tragus in contact with the panels 102, generate human body vibration sound transmitted through the tragus as well. The panels 102 preferably abut the tragus or the antitragus. Thus vibration of the panels 102 can be transmitted to the tragus or the antitragus efficiently.

Figure 3:
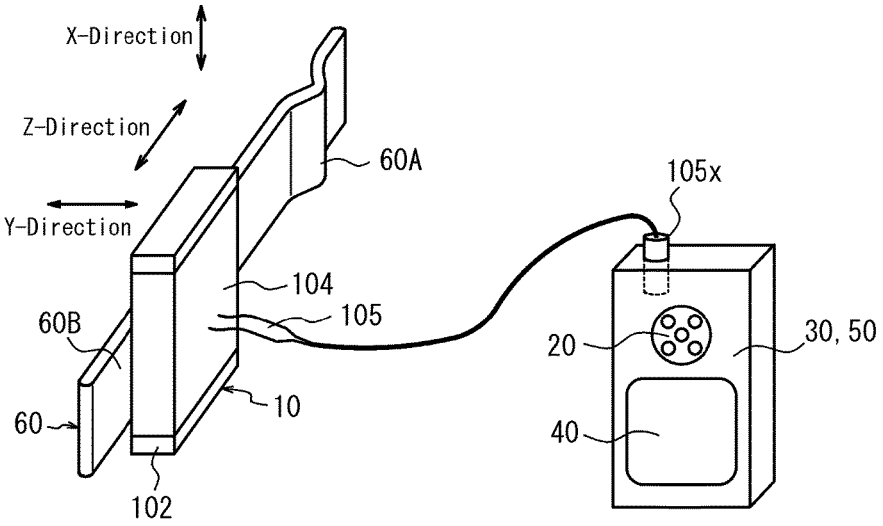
FIG. 3 is a diagram illustrating an external view of the hearing aid.

FIG. 3 is a schematic drawing illustrating a configuration of the hearing aid 1 according to one embodiment of this disclosure. As illustrated in FIG. 3, the hearing aid 1 includes the vibrator 10 and the holder 60. Then the vibrator 10 has the piezoelectric elements 101 and the panels 102. The vibrator 10 is about 2 mm to 10 mm thick (Y-direction), about 1 cm to 2 cm long (Z-direction) and about 0.8 cm to 2.2 cm width (X-direction). With such a size, the hearing aid 1 can be appropriately mounted between the tragus and the antitragus of the user's ear.

Further, a lead wire 105 for supplying power to the piezoelectric elements 101 is drawn from a portion of the vibrator 10 and is connected to the controller 30. The tip of the lead wire may be a connector jack 105*x* having a standardized shape so that it is applicable to the applications other than the hearing aid, thereby allowing connection to various electronic devices.

The vibrator 10 is attached to the holder 60 formed of a long plate member disposed approximately along the Z-direction. The holder 60 has, at a predetermined position from one end thereof, a curved portion 60A that bends (toward the Y-direction) from the main surface of the plate in a protruding manner. Then, a plate portion 60B formed in a plate shape extends from the curved portion 60A toward the other end (along the Z-direction).

The holder 60 can be easily made by resin molding such as acrylic resin, for example. The holder 60 is approximately from 2.6 cm to 3.5 cm long in the longitudinal direction (Z-direction). Further, the holder 60 may have a width (X-direction) and a thickness (Y-direction) that is sufficient to cause the user no pain during its long hours use when it is held by the user's ear and to allow for holding of a hearing aid itself with an appropriate pressing against the user's ear. For example, the width (X-direction) may be from about 4 mm to 12 mm and the thickness may be from about 1.5 mm to 2.5 mm. Note that, in this embodiment, the controller 30 and the microphone 20 are provided as a separate member, thus the holder 60 may hold only the vibrator 10 and the holder 60 itself.

Moreover, the vibrator 10 is attached to the main surface of the plate portion 60B along the X-direction and the Z-direction. The vibrator 10 may be attached to the holder 60 by attaching the peripheral wall portion 104 of the vibrator 10 to the holder 60 with adhesive. Note that the side of the peripheral wall portion 104 attached to the plate portion 60B may be partially formed by using a hard material to allow for a good holding state. Alternatively, a part of the rigid body 103 may be exposed from the peripheral wall portion 104 so that it is directly attached to the holder 60. Alternatively, a part of the rigid body 103 may be exposed from the peripheral wall portion 104 so that it is partially embedded into the holder 60. Thus, for example, even in the case where only the tragus side abuts and transmits vibration, the holder 60 can hold the vibrator 10 so as not to lose vibration of the vibrator 10. Therefore a transmission efficiency of vibration is improved.

Figure 4:
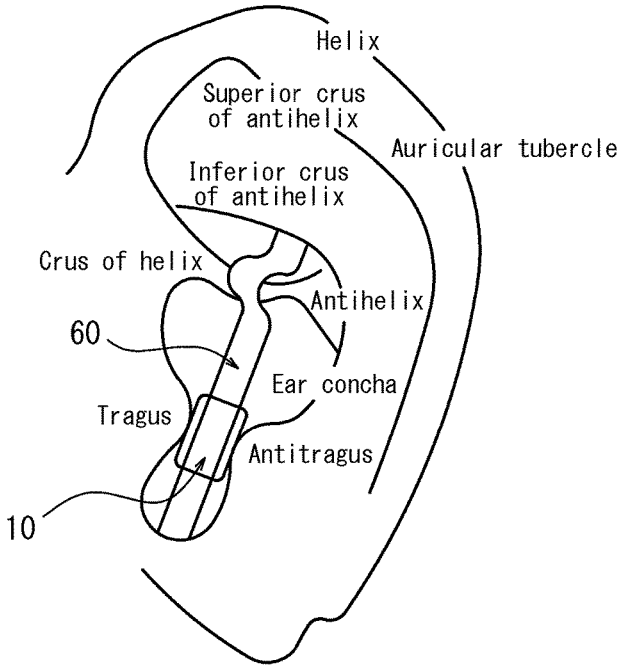
FIG. 4 is a diagram illustrating a state where the hearing aid is mounted on the user's ear.

As illustrated in FIG. 4, the hearing aid 1 according to this embodiment allows the vibrator 10 to abut the user's tragus or antitragus from the inside of the user's ear to transmit vibration to the tragus or the antitragus, thereby allowing the sound to be heard by the user. Here, "allows the vibrator 10 to abut the user's tragus or antitragus from the inside of the user's ear" means that, when the vibrator 10 is disposed inside of the ear, it is allowed to abut the tragus or the antitragus from a vicinity of the entrance of the external ear canal. In the example illustrated in FIG. 4, the vibrator 10 is allowed to abut the user's tragus from the inside of the user's ear.

Preferably the vibrator 10 is pressed against the user's ear with a force from 0.1N to 3N. When the vibrator 10 is pressed in the range from 0.1N to 3N, vibration by the vibrator 10 is sufficiently transmitted to the ear. Further, when pressed with a small force of less than 3N, the user may have no feeling of fatigue when wearing the hearing aid 1 for a long period of time, thus comfort during wear can be maintained.

Further, as illustrated in FIG. 4, in the hearing aid 1 according to this disclosure, the external ear canal is not sealed by the vibrator 10 and the holder 60. Therefore the disclosed hearing aid 1 may cause no feeling of muffled sound, thus comfort during wear can be maintained.

In the hearing aid 1 according to this embodiment, one end of the holder 60 along the Z-direction goes into the back side of the inferior antihelix crus of the user's ear and butts against inside of the ear, and the other end of the holder 60 along the Z-direction passes through between the tragus and the antitragus and butts against the lower end of the user's ear. Thus the holder 60 is caught in the ear with its longitudinal direction (Z-direction) applied with a stress, and serves as a holder.

When the holder 60 is mounted on the user's ear, its main surface may be bent toward the Y-direction illustrated in FIG. 3 by the stress generated against the holder 60. Note that the moving direction of the panel 102 caused by expansion/contraction of the piezoelectric elements 101 is the X-direction, which is different from the direction in which the above-mentioned holder 60 bends. Then, the stress caused by deformation of the piezoelectric elements 101 to move the panels 102 is a force along the X-direction of the holder 60, thus, for example, it is less likely that movement of the panels 102 may cause the holder 60 to bend toward the Y-direction in a protruding manner, and it is less likely for transmission energy to be dissipated. Thus an acoustic device such as a hearing aid, or the like, that causes less decrease in transmission efficiency of vibration can be provided.

The panels 102 of the vibrator 10 are held in a manner as described above, thus it abuts the user's tragus from inside of his/her ear. Then, the panels 102 bend against the tragus and vibrate, thereby allowing for transmission of vibration to the tissue of the user's ear around the tragus.

Further, for the curved portion 60A of the holder 60, the portion thereof opposed to the swell of the crus of helix bends so that the holder 60 will not press the crus of helix of the user's ear too much or abutting the crus of helix can be avoided as much as possible. Such a structure is effective for long hours of wear.

Note that this embodiment describes an example where the acoustic device is the hearing aid 1, but it is not limited thereto. For example, the acoustic device may be a headphone or an earphone, and in this case, the microphone 20 for collecting ambient sound may not be needed. Further, in this case, the sound based on the music data stored in the memory inside of the acoustic device or the sound based on the music data stored in an external server or the like may be reproduced by the acoustic device through the network.

Note that, although this embodiment describes an example where the vibrator 10 is allowed to abut the user's tragus from inside of the user's ear to transmit vibration to the tragus, thereby allowing the sound to be heard by the user, the example is not limited thereto. For example, the vibrator 10 may be allowed to abut the user's antitragus from the inside of the user's ear to transmit vibration to the antitragus, thereby allowing the sound to be heard by the user, or the vibrator 10 may be allowed to abut the user's tragus or antitragus from the outside of the user's ear to transmit vibration to the tragus or the antitragus, thereby allowing the sound to be heard by the user. Note that "allowed to abut the user's tragus or antitragus from the outside of the user's ear" means that a part of the vibrator 10 is located outside of the external ear canal and is allowed to abut the tragus or the antitragus in approximately parallel with the cheek or the temple.

Further, although the above embodiment describes an example where the vibrator 10 is attached to the main surface of the holder 60, a part of the holder 60 may be made thicker and provided with a hole therein, and the vibrator 10 may be disposed in the hole.

Alternatively, in the above embodiment, an acoustic device in which sound is heard by transmitting vibration has been described, but along with the vibrator 10, a sound generator that generates air conduction sound may be held by the holder 60. Even in this case, the holding structure does not block the external ear canal, thus it is less likely to cause muffled sound.

Alternatively, in the above embodiment, although the microphone 20 is disposed in a separate housing, it may be disposed, for example, in the holder 60. In this case, a microphone is disposed close to the ear, and thus the user can hear the sound which is similar to the sound heard by his/her ear. In that case, a howling prevention technique according to the prior art may be used together.

Although this disclosure has been described with reference to the accompanying drawings and embodiment, it is to be noted that various changes and modifications will be easily made by those skilled in the art based on this disclosure. Therefore, these changes and modifications are included in the scope of this disclosure. For example, the functions or the like included in each means, each member, or the like, that are disclosed herein may be reordered in any logically consistent way, and a plurality of means, members, or the like, may be combined into one or divided.

REFERENCE SIGNS LIST

1: Acoustic device (Hearing aid)
10: Vibrator (Sound generator)
20: Microphone
30: Controller
31: Analog-digital converter
32: Signal processor
33: Digital-analog converter
34: Piezoelectric amplifier
40: Volume adjusting interface
50: Memory
60: Holder
101*x*, 101*y*, 101*z*: Piezoelectric element
102*x*, 102*y*: Panel
103: Rigid body
104: Peripheral wall portion
105: Lead wire
105*x*: Connector jack

The invention claimed is:

1. An acoustic device, comprising: a holder that has one end abutting inside of an inferior antihelix crus and other end abutting a depression between a tragus and an antitragus of a user's ear; and a vibrator that is held by the holder and, based on an audio signal, expands and contracts in a direction intersecting a direction of connecting the one end and the other end, and by the expansion and the contraction, causes the ear to vibrate, wherein the vibrator comprises a first piezoelectric element and a second piezoelectric element, wherein a rigid body is provided between the first and second piezoelectric elements, wherein the rigid body has a bent shape, and wherein the rigid body is configured so that the first piezoelectric element and the second piezoelectric element expand in opposite directions at the same time.

2. The acoustic device according to claim 1, wherein the vibrator comprises the first and second piezoelectric elements and panels, and the first and second piezoelectric elements expand and contract along the direction intersecting the direction of connecting the one end and the other end, and the panels vibrate along the direction intersecting the direction of connecting the one end and the other end.

3. The acoustic device according to claim 1, wherein the vibrator abuts the user's tragus from inside of the user's ear to transmit the vibration to the tragus.

4. The acoustic device according to claim 1, wherein the vibrator abuts the user's antitragus from the inside of the user's ear to transmit the vibration to the antitragus.

5. The acoustic device according to claim 1, wherein the vibrator is disposed so that it locates between the tragus and the antitragus.

6. The acoustic device according to claim 1, wherein a direction in which the vibrator expands and contracts and a direction in which the holder bends occurring when the holder is mounted on the user's ear are different from each other.

7. The acoustic device according to claim 1, wherein the holder bends, in a region opposed to a crus of helix, in a direction away from the crus of helix.

8. The acoustic device according to claim 1, wherein an external ear canal is not sealed by the acoustic device.

9. The acoustic device according to claim 1, wherein the vibrator abuts the user's tragus from outside of the user's ear to transmit the vibration to the tragus, thereby allowing sound to be heard by the user.

10. The acoustic device according to claim 1, wherein the vibrator abuts the user's antitragus from the outside of the user's ear to transmit the vibration to the antitragus, thereby allowing sound to be heard by the user.

11. The acoustic device according to claim 1, wherein external ear canal radiation sound is generated in the user's ear by the vibrator.

12. The acoustic device according to claim 1, wherein the vibrator is pressed against the user's ear with a force from 0.1 N to 3 N.

13. The acoustic device according to claim 1, further comprising a microphone.

* * * * *